United States Patent [19]

Melnyk

[11] Patent Number: 4,546,824

[45] Date of Patent: Oct. 15, 1985

[54] HEAT EXCHANGER

[75] Inventor: William Melnyk, Lathrup Village, Mich.

[73] Assignee: McCord Heat Transfer Corporation, Walled Lake, Mich.

[21] Appl. No.: 591,291

[22] Filed: Mar. 19, 1984

[51] Int. Cl.[4] ..... F28F 9/18

[52] U.S. Cl. ..... 165/153; 165/175

[58] Field of Search ..... 165/173, 175, 153

[56] References Cited

U.S. PATENT DOCUMENTS

| | | | |
|---|---|---|---|
| 2,735,698 | 2/1956 | Brinen | 165/173 |
| 4,155,346 | 5/1979 | Aresty | 165/173 X |
| 4,159,034 | 6/1979 | Bellovary et al. | 165/153 |
| 4,246,958 | 1/1981 | Sagan et al. | 165/173 X |
| 4,458,749 | 7/1984 | Melnyk | 165/175 X |

FOREIGN PATENT DOCUMENTS

| | | | |
|---|---|---|---|
| 1018143 | 1/1966 | United Kingdom | 165/173 |

*Primary Examiner*—William R. Cline
*Assistant Examiner*—Peggy A. Neils

[57] ABSTRACT

There is disclosed a tube-to-header joint arrangement for a heat exchanger wherein the tubes include an oblong or flattened body which is off-set to one side with respect to cylindrical ends formed on the tubes. The off-set bodies facilitate staggering alternate rows of collared openings formed in the header to thereby maintain a predetermined minimum distance between adjacent collars to avoid fatigue or failure of the header, while permitting maximum diameter openings to be employed for maximum surface area contact between each tube and header collar for a stronger joint therebetween.

4 Claims, 3 Drawing Figures

HEAT EXCHANGER

TECHNICAL FIELD

This invention relates generally to heat exchangers and, more particularly, to the tube-to-header connection therefor.

BACKGROUND ART

It is known to use an oval or flat sided tube which is formed to have round ends for mounting in openings in the headers at the upper and lower ends of a radiator. Such round end mounting arrangements are known to provide a strong tube-to-header joint. The larger the diameter of the ends, the more the area of contact between the two components and, hence, the stronger the joint. However, the diameter becomes limited when it is realized that predetermined minimum spaces must be maintained between adjacent openings in the headers, thus limiting the advantages of the round tube-to-header joints.

DISCLOSURE OF THE INVENTION

Accordingly, a general object of the invention is to provide an improved tube-to-header joint in a heat exchanger.

Another object of the invention is to provide an improved cylindrical tube-to-header joint.

A further object of the invention is to provide a cylindrical tube end which is offset from the center of an oblong, oval or flat sided tube body to enable the area of interconnection between each cylindrical end header opening to be as large as possible, while maintaining a desired minimum distance between adjacent openings in the upper and lower headers.

These and other objects and advantages of the invention will be apparent when reference is made to the following description and accompanying drawings.

BEST MODE OF CARRYING OUT THE INVENTION

Figure 1:
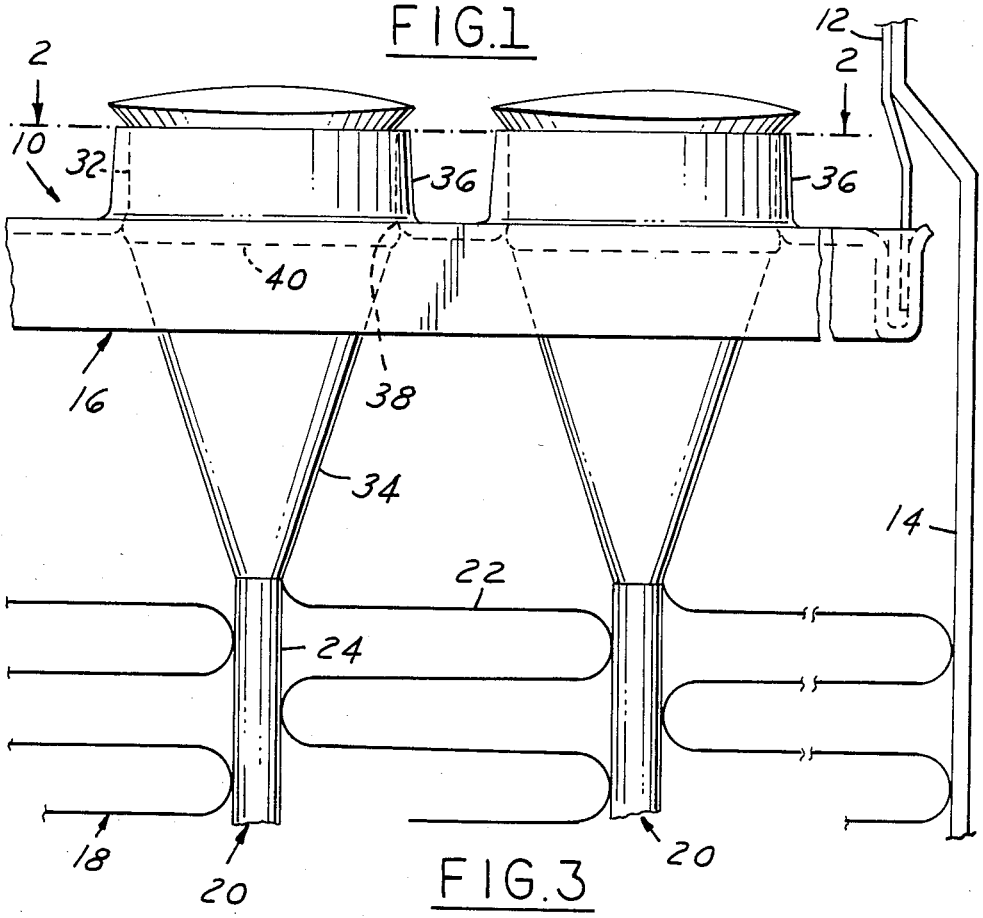
FIG. 1 is a fragmentary side elevational view of a heat exchanger tube-to-header joint arrangement.
Figure 2:
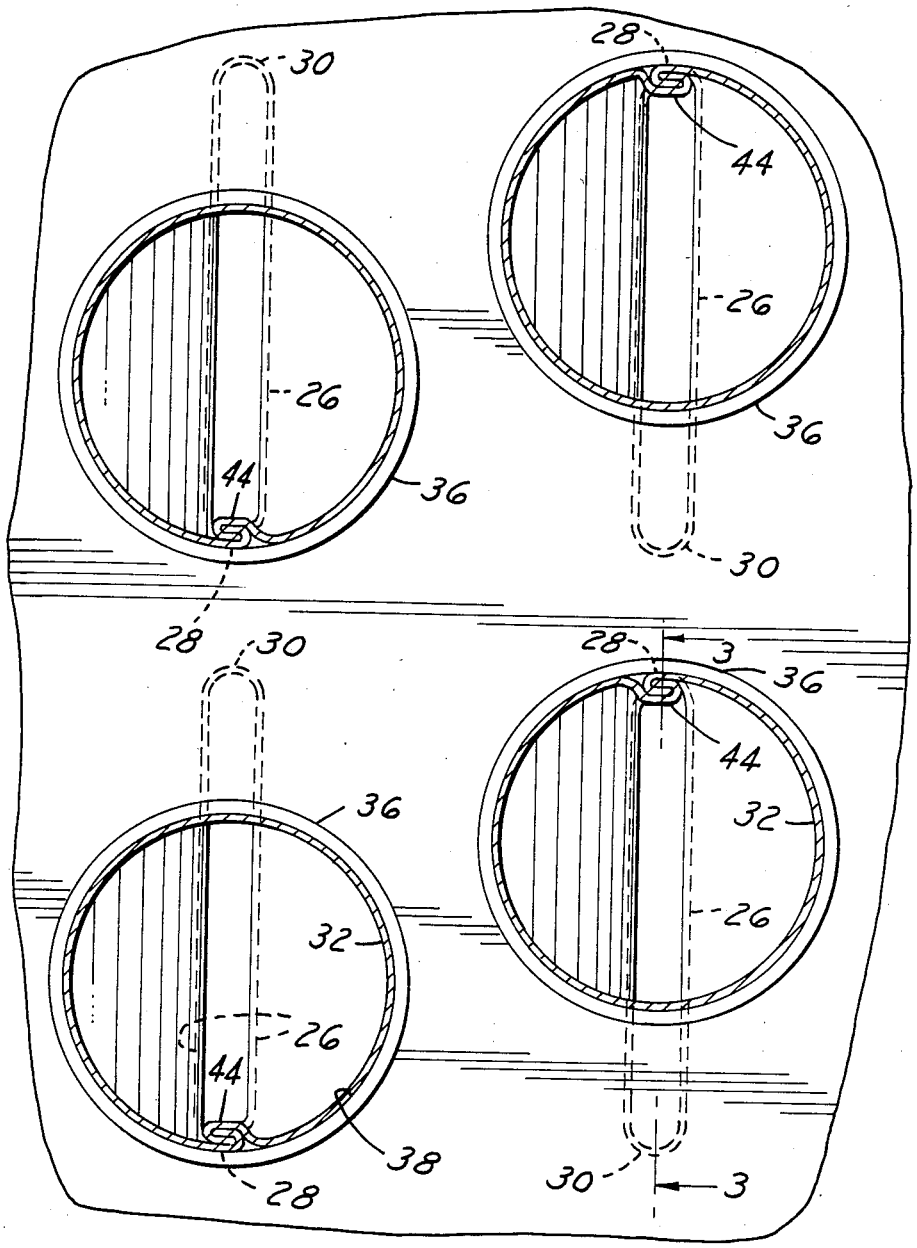
FIG. 2 is an enlarged cross sectional view taken along the plane of the line 2—2 of FIG. 1, and looking in the direction of the arrows.

Referring now to the drawings in greater detail, FIG. 1 illustrates a heat exchanger 10 including top and bottom tanks, represented at 12, and having side channels 14, top and bottom headers 16 and an intermediate core assembly 18. The core assembly includes a plurality of vertically oriented tubes 20 and intermediate serpentine fins 22. In some applications, transversely oriented flat sheet metal fins may be used in lieu of the serpentine fins. Each tube 20 is formed to include a body section 24 having flattened, parallel sides 26 and rounded interconnecting edges 28 and 30, axially aligned cylindrical end sections 32, and a transition section 34 between the body portion 24 and each of the cylindrical end sections 32. The cylindrical ends are extended through outwardly extending collars 36 formed around openings 38 in each header 16, and secured therein in any convenient manner, such as by soldering. As shown in FIG. 2, the openings in each row are equally spaced, while alternate rows are staggered with respect to each adjacent row.

Figure 3:
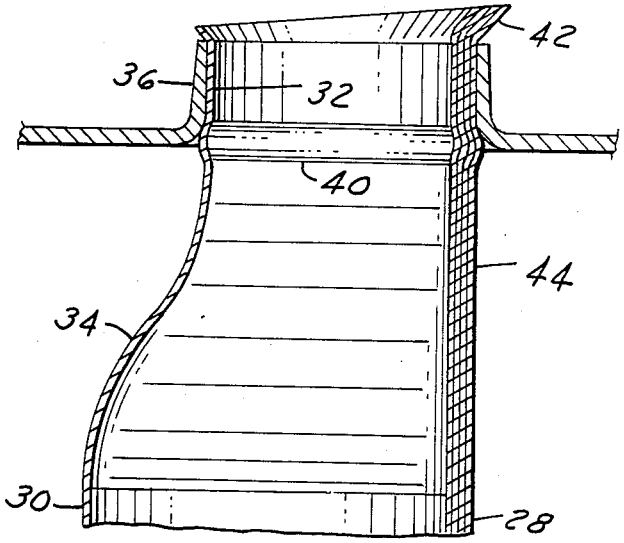
FIG. 3 is a cross sectional view taken along the plane of the line 3—3 of FIG. 2, and looking in the direction of the arrows.

As shown in FIGS. 2 and 3, the flat-sided, oblong bodies 24 are off-set to one side, such that the rounded edge 28 thereof is axially aligned with the outer periphery of the cylindrical ends 32, while the rounded edge 30 is radially outward of the outer periphery of the round ends. As seen from the side in FIG. 3, the rounded edge 30 assumes an "S" shape along the length of the transition section 34 as it blends from the oblong or flat-sided body 24 configuration into the cylindrical end 32 configuration.

Suitable retainer means, such as an annular collar 40 (FIG. 3), or a plurality of equally spaced protrusions may be formed around the cylindrical end 32, just inside the header 16 in the vicinity of the juncture between the cylindrical end and the adjacent transition section 34. Once installed, the outer edge of each cylindrical end 32 may be formed to include an outwardly extending flare 42 engaging the outer edge of the adjacent collar 36. Thus, the tube collars 40 and flares 42 serve to mechanically lock the header 16 and its collars 36 therebetween so as to be better able to withstand the forces resulting from thermal expansion and normal operational stresses.

As may be noted in FIG. 2, with the off-set rounded edges 30 pointing in one direction along alternate rows of openings 38, and in the opposite direction along adjacent alternate rows of openings 38, the adjacent rows of openings 38 may be staggered and, hence, a predetermined minimum distance may be maintained between adjacent collars 36, with less tendency for the header to fatigue or fail than if the rows of openings 38 were aligned laterally in FIG. 2. This also serves to accommodate a larger diameter opening 38 and cylindrical end 32 than if the openings 38 were aligned both longitudinally and laterally in FIG. 2, providing a greater area of contact therebetween for more secure interconnection between the tubes and the headers.

If desired, the tubes 20 may be formed so as to have the longitudinal edges which meet at the rounded edge 28 interconnected as a lock seam 44 (FIG. 2), i.e., bent so as to become interlocked with one another. Other suitable connection means may be utilized in lieu of the lock seam 44, if desired, without interfering with the invention.

INDUSTRIAL APPLICABILITY

It should be apparent that the invention provides an improved tube-to-header joint in that maximum header distance may be maintained between the collars around the header openings, and the circumferential contact area headers and tubes may be increased.

While but one embodiment of the invention has been shown and described, other modifications thereof are possible.

The embodiments of the invention in which an exclusive property or privilege is claimed are defined as follows:

1. A heat exchanger comprising upper and lower tanks including respective upper and lower headers, a plurality of tubes, each of said tubes having a body section with flattened, parallel sides and interconnecting rounded edges, axially aligned cylindrical end sections, and a transition section between said body section and each of said cylindrical end sections, and means for connecting each of said plurality of tubes at their cylindrical ends to the respective upper and lower headers, said flattened, parallel sides being off-set in one direction with respect to the axis of said cylindrical end sections such that one side of said transition section is aligned with a side of said cylindrical ends and with one of said rounded edges of said body section, and the opposite side of said transition section blends between the other of said rounded edges of said body section and the opposite side of said cylindrical ends.

2. The heat exchanger described in claim 1, wherein the off-set rounded edges of alternate rows of tubes point in one direction and the off-set rounded edges of adjacent alternate rows of tubes point in the opposite direction, while maintaining a controlled predetermined distance between the staggered cylindrical end sections of adjacent rows of tubes.

3. The heat exchanger described in claim 1, wherein said headers each include a plurality of openings formed therein, and a cylindrical collar formed around each opening, with a cylindrical end section being extended through and secured to each collar.

4. The heat exchanger described in claim 3, and a flare formed on the free edge of each cylindrical end section adjacent the free edge of each collar, and retainer means formed on each tube at the juncture between the cylindrical end section and the transition section to thereby mechanically lock the header therebetween.

* * * * *